United States Patent [19]

Watari et al.

[11] Patent Number: 4,780,695

[45] Date of Patent: Oct. 25, 1988

[54] REFRACTORY LEAKAGE COAXIAL CABLE

[75] Inventors: Toru Watari; Hideaki Saito; Hideki Yagyu; Takashi Namekawa, all of Ibaraki, Japan

[73] Assignee: Hitachi Cable Ltd., Tokyo, Japan

[21] Appl. No.: 13,338

[22] Filed: Feb. 11, 1987

[30] Foreign Application Priority Data

Feb. 12, 1986 [JP] Japan ..... 61-18625[U]

[51] Int. Cl.[4] ..... H01P 3/06; H01B 7/34

[52] U.S. Cl. ..... 333/237; 174/121 A; 156/54

[58] Field of Search ..... 333/237, 243; 174/29, 174/70 A, 110 N, 110 FC, 121 A; 156/54

[56] References Cited

U.S. PATENT DOCUMENTS

| | | | |
|---|---|---|---|
| 3,309,455 | 3/1967 | Mildner | 156/54 X |
| 4,159,920 | 7/1979 | Anderson et al. | 156/54 |
| 4,280,225 | 7/1981 | Willis | 333/237 X |
| 4,378,462 | 3/1983 | Arnold, Jr. et al. | 156/54 X |
| 4,605,818 | 8/1986 | Arroyo et al. | 156/54 X |
| 4,659,871 | 4/1887 | Smith et al. | 174/121 A X |

FOREIGN PATENT DOCUMENTS

| | | |
|---|---|---|
| 52-16682 | 2/1977 | Japan . |
| 55-03537 | 1/1980 | Japan . |

OTHER PUBLICATIONS

Shinolo et al., *Development of Fire-Protected Leaking Coaxial Cable,* Sep. 1975.

*Primary Examiner*—Paul Gensler

*Attorney, Agent, or Firm*—Cushman, Darby & Cushman

[57] ABSTRACT

A fire resistant refractory leakage coaxial cable assembly formed by placing a sheet of heat resistant organic film between the internal conductor and the external conductor of a leakage coaxial cable. The seam formed by the two edges of the film is positioned upwardly, so that molten insulated material will be contained by the film without flowing through the seam.

16 Claims, 1 Drawing Sheet

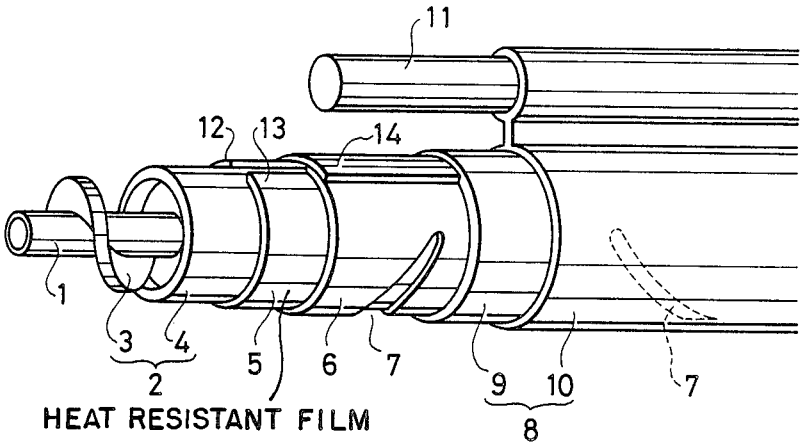
11
12
13
14
1
3
4
2
5
6
7
9
10
8
7
HEAT RESISTANT FILM

REFRACTORY LEAKAGE COAXIAL CABLE

BACKGROUND OF THE INVENTION

1. Field of the Invention

The present invention relates to the field of leakage coaxial cables which are used for radio communication in closed in areas such as the interior of buildings, tunnels or underground markets, where no ordinary radio waves can be received.

2. Description of the Prior Art

A leakage coaxial cable typically has slots formed in the exterior thereof which are spaced at predetermined intervals along the conductor, so that electromagnetic waves propagating inside the coaxial cable are partially radiated from the conductor into an external space through the slots.

When a fixed signal source is connected to the leakage coaxial cable, the signal is radiated into the external space and may be received by a mobile station running near the leakage coaxial cable. In addition, a signal transmitted by the mobile station may be received by the fixed station through the leakage coaxial cable.

A common application for leakage coaxial cables has been in disaster warning and prevention system for use in building, tunnels and underground markets. It is important in such applications to make certain that the cables are fireproof. The ability of prior art leakage coaxial cables to withstand high heat has been limited. Consequently, there has existed a long and unfilled need in the prior art for a method of making leakage coaxial cables that have transmission characteristics which will not degrade during a fire related emergency.

A conventional leakage coaxial cable has an external conductor with slots formed therein to radiate an electromagnetic wave which is propagating inside the cable outwardly into an external space. The external conductor is disposed coaxially around an internal conductor with an insulating member therebetween. The external conductor is covered by a protective sheath. In order to minimize the transmission loss of the electromagnetic wave, the insulating member is preferably made of a low-loss plastic material, such as polyethylene or polystyrene. The external conductor is preferably made of high-conductivity material such as alminum or copper. A polyester film is laminated on the external conductor with adhesive to compensate for the decrease of the mechanical strength of the conductor which is caused by the formation of the slots. The protective sheath is preferably made of polyethylene or polyvinyl chloride.

If a leakage coaxial cable thus constructed encounters a fire, the protective sheath will burn away and the external conductor will be directly exposed to the flames. The polyester will burn, and the plastic insulating member will melt. The molten plastic will flow through the slots formed in the external conductor, ignite and drop from the cable while burning. The burning molten plastic may actually contribute to the spread of the fire and may burn the skins or clothes of persons fighting the fire or running away from the fire.

One example of a prior art method of making a leakage coaxial cable refractory has been disclosed in Japanese Utility Model Application Publication No. 16682/1977. In that method, a heat-resistant tape which is made of an inorganic material such as asbestos is spirally wound between a polyethylene insulating member and an external conductor. The heat-resistant tape prevents the melting of the polyethylene insulating material for a long time. In addition, the heat-resistant tape maintains the insulation between the internal and external conductors even after the polyethylene insulating member has been molten. Therefore, the radio communication properties of the cable can be maintained unchanged for some time after the occurrence of the fire.

However, the leakage coaxial cable disclosed in Japanese Utility Model Application Publication No. 16682/1977 is still not an ideal solution to the problem discussed above, since the polyethylene insulating material will eventually ooze out through the stitch lines of the non-organic tape or the seams of the spirally wound tape and flow out through the slots. In addition, since the tape is relatively thick, on the order of 0.25 to 0.5 mm, the dielectric value between the internal and external conductors is large, causing large transmission losses.

Another example of a prior art conventional leakage coaxial cable is disclosed in Japanese Utility Model Application (OPI) No. 3537/1980. In that cable, a heat-resisting tape of polyimide resin is spirally wound between an external conductor and a polyethylene insulating member. Because of the presence of the heat-resisting tape, the internal and external conductors are not short-circuited even if the polyethylene insulating member is molten.

However, that leakage coaxial cable also has the problem of the polyethylene insulating member oozing out through the seams of the spirally wound tape, flowing out through the slots and dropping from the cable while burning.

SUMMARY OF THE INVENTION

An object of the present invention is to eliminate the above-described difficulties accompanying a conventional leakage coaxial cable. More specifically, an object of the present invention is to provide a refractory leakage coaxial cable in which the insulating member is prevented from flowing out of the cable and burning when the cable encounters a fire.

In a refractory leakage coaxial cable according to the present invention, a film of heat-resistant organic material is longitudinally folded between an insulating member and an external conductor in such a manner that the film covers the insulating member coaxially, and both edges of the film face upwardly when the cable is installed.

The film of heat-resistant organic material (hereinafter referred to merely as "a heat-resistant film", when applicable) will not decompose even at temperatures as high as 500° C. Examples of the heat-resistant organic materials which may be used according to the present invention are polyimide resin, and polytetrafluoroethylene resin. The film is preferably 10 to 50 μm in thickness. The film is longitudinally folded about the insulating material in such a manner that both edges of the film face upwardly when the cable is installed. Consequently, even if the insulating material is melted by the heat of a fire, it will not flow out of the cable. In addition, even when the insulating material is molten, the heat-resistant film prevents the short-circuiting of the internal and external conductors, so that the radio communication can be continued.

If a laminate tape which is formed by laminating the heat-resistant tape and a metal tape such as an aluminum tape for forming the external conductor is employed, the heat-resistant film will reinforce the external conductor, and the reinforcing film can be eliminated. Lamination of the heat-resistant film and the external conductor is not an essential feature of the invention; that is, the heat-resistant film and the external conductor may be used in conjunction with each other. In the latter case, the external conductor should be one which is laminated by a reinforcing film such as a polyester film.

It is undesirable that the protective sheath be burnt down immediately when exposed to a fire. Therefore, the material of the protective sheath should be such that it will be carbonized or ashed before dropping from the cable, i.e. it is preferable that the protective sheath be made of fire-resistant material. However, if the protective sheet of fire resistant material is provided directly on the external conductor, then the transmission loss is increased, because the fire resistant material has a high dielectric value. In order to overcome this difficulty, it is preferable to cover the external conductor with an internal sheath of low-loss material such as polyethylene and to cover the internal sheath with an external sheath of fire resistant material. The fire resistant material may be one which essentially contains polyvinyl chloride, or one which is prepared by adding a inorganic fire resistant a9ent such as magnesium hydroxide or hydrate alumina to a matrix of polyolefin such as polyethylene.

BRIEF DESCRIPTION OF THE DRAWINGS

The single FIGURE provides a perspective cutaway view showing a preferred embodiment of a refractory leakage coaxial cable constructed according to the present invention.

DETAILED DESCRIPTION OF THE PREFERRED EMBODIMENT

The single FIGURE in the accompanying drawing shows a preferred embodiment of a refractory leakage coaxial cable constructed according to the present invention. In the FIGURE, reference numeral 1 designates an internal conductor which is preferably an aluminum pipe.

An insulating member 2 is formed around the internal conductor 1. Insulating member 2 preferably consists of a plastic strip 3 spirally wound on the internal conductor 1, and a plastic tube 4 extruded around the plastic strip 3. The plastic strip 3 and the plastic tube 4 are both preferably formed of polyethylene to minimize signal loss.

A heat-resistant film 5 and an external conductor 6 are formed around the insulating member 2. The film 5 and external conductor 6 are joined by laminating a polyimide film 25 μm in thickness and an aluminum tape having the slots 7 by means of an adhesive. The tape thus formed is longitudinally folded about the insulating member 2 with the aluminum tape outside. As shown in the drawing, an overlap 14 of the external conductor 6 roughly coincides in position with both edges 12 and 13 of the heat-resistant film 5. A messenger wire 11 is laid along the overlap 14. Therefore, when the cable is installed, the two edges 12 and 13 of the heat-resistant film 5 are held so they face upwardly at all times. Accordingly, the molten insulator cannot flow through the gap defined between the edges 12 and 13 of film 5 during a fire related emergency. The film means 5 may be formed of several types of heat-resistant organic material such as polyimide resin, polyamide resin, phenol resin and polytetrafluoroethylene (PTFE) resin.

The protective sheath 8 preferably consists of an internal sheath 9 and an external sheath 10. The internal sheath 9 is preferably formed by extruding polyethylene, and has a preferred wall thickness of 1 mm. The external sheath 10 is formed by extruding polyvinyl chloride resin, and has a preferred wall thickness of 2 mm.

In order to confirm the performance of the refactory leakage coaxial cable thus constructed, 1000 cc of ethyl alcohol was placed 200 mm below the coaxial cable (which is preferably 50 mm in outside diameter) and ignited. In about ten minutes, part of the protective sheath, being carbonized or ashed, was burnt down. However, the polyethylene never flowed out during 25 minutes of continuous heating, and the flames extinguished themselves after all of the alcohol had burned.

The same test was given to a prior art leakege coaxial cable in which a polymide tape was spirally wounded around an insulating member 2 and a laminate tape formed by laminating an aluminum tape and a polyester film was longitudinally folded about the insulatihg member. In the test, after the protective sheath was burned away, the polyethylene melted, dripped from the slots and ignited. The molten polyethylene continued to burn for nearly 10 minutes after all of the alcohol had burned away.

As discussed above, the leakage coaxial cable according to the present invention provides the following benefits:

(a) Even if the polyethylene insulating member 2 has been melted by a fire, it is held in the cable. Therefore, the polyethylene is prevented from burning and dripping, so that no secondary disaster is caused.

(b) Even if the polyethylene insulating member has been melted, short-circuiting of the internal and external conductor is prevented by the heat-resistant film 5. Therefore radio communication activity can be maintained indefinitely during a fire related emergency.

(c) The use of the organic heat-resistant film, which is only 10 to 50 μm in thickness, can decrease the dielectric loss between the internal and external conductors, thus permitting a low-loss transmission, when compared with the transmission losses caused by the prior art use of inorganic material.

Other objects, features, and characteristics of the present invention, as well as the methods and operation and functions of the related elements of the structure, and to the combination of parts and economies of manufacture, will become apparent upon consideration of the following description and the appended claims with reference to the accompanying drawing, all of which form a part of this specification.

While the invention has been described in connection with what is presently considered to be the most practical and preferred embodiment, it is to be understood that the invention is not limited to the disclosed embodiment, but, on the contrary, is intended to cover various modifications and equivalent arrangements included within the spirit and scope of the appended claims.

I claim:

1. A refractory leakage coaxial cable assembly comprising an internal conductor means;

an external conductor means having a plurality of slots formed therein to leak a signal propagating within the cable assembly to an exterior space;

means for insulating said internal conductor means from said external conductor means; and a heat-resistant film means longitudinally folded between said insulating means and said external conductor means, said film means defining a seam between two edges thereof which faces upwardly, whereby in the event of a fire related emergency, said insulating means will be contained within said film means even after melting.

2. A refractory leakage coaxial cable assembly according to claim 1, wherein said film means is laminated to said external conductor means with an adhesive.

3. A refractory leakage coaxial cable assembly according to claim 1, wherein said insulating member comprises a plastic strip spirally wound on said internal conductor; and a plastic tube formed around said plastic strip.

4. A refractory leakage coaxial cable assembly according to claim 3, wherein said plastic strip and said plastic tube are made of polyethylene.

5. A refractory leakage coaxial cable assembly according to claim 1, wherein said film means is made of a heat-resistant organic material selected from the group consisting of polyimide resin, polyamide resin, phenol resin and polytetraflouroethylene resin.

6. A refractory leakage coaxial cable assembly according to claim 1, wherein said external conductor is made of aluminum.

7. A refractory leakage coaxial cable assembly according to claim 1, further comprising:

a protective sheath means for surrounding and protecting said external conductor means.

8. A refractory leakage coaxial cable assembly comprising:

an internal conductor means;

an external conductor means disposed about said internal conductor means and having a plurality of slots formed therein to leak a signal propagating within the cable assembly to an exterior space;

a protective sheath means for surrounding and protecting said external conductor means, including an internal sheath formed of a material having a low dielectric value and an external sheath of fire resistant material;

means for insulating said internal conductor means from said external conductor means; and a heat resistant film means longitudinally folded between said insulating means and said external conductor means, said film means defining a seam between two edges thereof which faces upwardly, whereby in the event of a fire-related emergency, said insulating means will be contained within said film means even after melting.

9. A refractory leakage coaxial cable assembly according to claim 8, wherein said film means is laminated to said external conductor means with an adhesive.

10. A refractory leakage coaxial cable assembly according to claim 8, wherein said insulating means comprises a plastic strip spirally wound on said internal conductor, and a plastic tube formed around said plastic strip.

11. A refractory leakage coaxial cable assembly according to claim 10, wherein said plastic strip and said plastic tube are made of polyethylene.

12. A refractory leakage coaxial cable assembly according to claim 8, wherein said film means is made of a heat-resistant organic material selected from the group consisting of polyimide resin, polyamide resin, phenol resin and polytetrafluoroethylene resin.

13. A refractory leakage coaxial cable assembly according to claim 8, wherein said external conductor is made of aluminum.

14. A refractory leakage coaxial cable assembly according to claim 8, wherein said internal sheath is formed of polyethylene.

15. A refractory leakage coaxial cable assembly according to claim 14, wherein said external sheath is formed essentially of polyvinylchloride.

16. A refractory leakage coaxial cable assembly according to claim 15, wherein said external sheath is formed of a polyolefin matrix which has an inorganic fire-resistant agent impregnated therein.

* * * * *